US012108897B2

(12) United States Patent
Marquez

(10) Patent No.: US 12,108,897 B2
(45) Date of Patent: Oct. 8, 2024

(54) DELIVERY SHELF

(71) Applicant: Giovanni Marquez, Lake Mary, FL (US)

(72) Inventor: Giovanni Marquez, Lake Mary, FL (US)

( * ) Notice: Subject to any disclaimer, the term of this patent is extended or adjusted under 35 U.S.C. 154(b) by 31 days.

(21) Appl. No.: 18/068,856

(22) Filed: Dec. 20, 2022

(65) Prior Publication Data

US 2023/0255384 A1 Aug. 17, 2023

Related U.S. Application Data

(60) Provisional application No. 63/309,242, filed on Feb. 11, 2022.

(51) Int. Cl.
*A47G 29/14* (2006.01)
*A47G 29/20* (2006.01)

(52) U.S. Cl.
CPC ..... *A47G 29/141* (2013.01); *A47G 29/20* (2013.01)

(58) Field of Classification Search
CPC ..... A47G 29/20; A47G 29/22; A47G 29/141; A47G 29/30; A47G 2029/145; A47G 2029/149
USPC ..... 108/91
See application file for complete search history.

(56) References Cited

U.S. PATENT DOCUMENTS 452,071 A * 5/1891 Deeves ..... A47G 29/12 232/38
922,181 A * 5/1909 Ohlson ..... A47G 29/12095 232/38
2,456,479 A * 12/1948 Antil ..... B65D 9/14 312/258
2,675,925 A 4/1954 Skar
4,351,247 A 9/1982 Clark
6,426,699 B1 * 7/2002 Porter ..... A47F 10/00 340/568.1
9,619,955 B2 4/2017 Eichenblatt
10,028,606 B1 * 7/2018 Ritchie ..... G07C 9/00912
10,537,196 B1 * 1/2020 MacPherson ..... A47G 29/141
10,696,453 B2 * 6/2020 Sena ..... A47G 29/141
10,743,695 B1 * 8/2020 Altmaier ..... B60R 9/065
10,870,498 B2 * 12/2020 Zambelli ..... B64U 70/90
11,197,566 B2 * 12/2021 Aresu ..... A47G 29/124
11,246,443 B2 * 2/2022 Lin ..... A47G 29/141
(Continued)

FOREIGN PATENT DOCUMENTS

CN 108349594 A * 7/2018 ..... A47G 29/141

*Primary Examiner* — William L Miller
(74) *Attorney, Agent, or Firm* — Boudwin Intellectual Property Law, LLC; Daniel Boudwin

(57) ABSTRACT

A delivery shelf is provided. The device includes a platform hingedly affixed to a mounting base, wherein a rear edge of the platform is hingedly affixed along a lower edge of the mounting base. The platform is selectively movable between a deployed position and a storage position. The platform is substantially perpendicular to the mounting base when in the deployed position and an upper surface of the platform rests flush against a front surface of the mounting base when the platform is in the storage position. An extension panel is telescopically disposed within a front edge of the platform, wherein the extension panel selectively moves between an extended position and a retracted position. The extension panel is disposed entirely within an interior of the platform when in the retracted position.

19 Claims, 5 Drawing Sheets

(56) References Cited

U.S. PATENT DOCUMENTS

| | | | | |
|---|---|---|---|---|
| 11,484,142 | B2 * | 11/2022 | Perez Friscia | G09F 17/00 |
| 11,497,335 | B2 * | 11/2022 | Romanucci | A47G 29/30 |
| 11,666,169 | B1 * | 6/2023 | Altmaier | A47G 29/20 232/33 |
| 11,751,708 | B2 * | 9/2023 | Wu | A47G 29/141 232/19 |
| 11,782,458 | B2 * | 10/2023 | Romanucci | B66F 9/063 414/352 |
| 2003/0006275 | A1 | 1/2003 | Gray | |
| 2004/0074957 | A1 * | 4/2004 | Devar | G07F 17/13 232/17 |
| 2012/0031960 | A1 * | 2/2012 | Skouboe | A47G 29/22 232/47 |
| 2013/0000525 | A1 | 1/2013 | Hall et al. | |
| 2018/0049575 | A1 * | 2/2018 | Yamrick | A47G 29/141 |
| 2018/0092484 | A1 * | 4/2018 | Lewis | G08G 5/0026 |
| 2018/0228310 | A1 * | 8/2018 | Enobakhare | A47G 29/20 |
| 2019/0180544 | A1 * | 6/2019 | Newcomb | E06B 7/32 |
| 2019/0217971 | A1 * | 7/2019 | Comerford | B64C 39/024 |
| 2019/0225375 | A1 * | 7/2019 | Sena | A47G 29/20 |
| 2019/0261802 | A1 * | 8/2019 | Vernal | A47G 29/20 |
| 2019/0320836 | A1 * | 10/2019 | Guanch | A47G 29/20 |
| 2020/0013008 | A1 * | 1/2020 | Newcomb | G05D 1/0022 |
| 2020/0093309 | A1 * | 3/2020 | Raphael | A47B 67/02 |
| 2020/0245798 | A1 * | 8/2020 | Perez Friscia | A47G 29/141 |
| 2020/0281386 | A1 * | 9/2020 | Knox | A47G 29/22 |
| 2020/0288895 | A1 * | 9/2020 | Bennet | H04W 12/03 |
| 2020/0352376 | A1 * | 11/2020 | Vernal Silva | A47G 29/1254 |
| 2020/0359819 | A1 * | 11/2020 | Roberts | A47G 29/141 |
| 2020/0385119 | A1 * | 12/2020 | Hanke | E06B 3/38 |
| 2022/0031105 | A1 * | 2/2022 | Newcomb | G06K 7/10366 |
| 2022/0089317 | A1 * | 3/2022 | Aliahmad | A47G 29/20 |
| 2022/0346583 | A1 * | 11/2022 | Evangelidis | A47G 29/20 |
| 2022/0361700 | A1 * | 11/2022 | Reinhard | B64C 39/024 |

* cited by examiner

DELIVERY SHELF

CROSS REFERENCE TO RELATED APPLICATIONS

This application claims the benefit of U.S. Provisional Application No. 63/309,242 filed on Feb. 11, 2022. The above identified patent application is herein incorporated by reference in its entirety to provide continuity of disclosure.

BACKGROUND OF THE INVENTION

The present invention relates to delivery receptacles. More particularly, the present invention pertains to a delivery shelf pivotally affixed to a mounting base, such that the shelf can be lowered when needed to store deliveries or other parcels thereon.

Many individuals utilize online shopping and delivery systems, and the prevalence of online shopping is continuously growing. As more online shopping transactions take place, more and more products must be delivered to the consumer's home. Such frequent deliveries require an individual to have sufficient space for the packages to be dropped off, however, many individuals lack space near their front door, mailbox, or the like. As a result, delivered packages are often left haphazardly in the vicinity, on the ground, or far from the door. Leaving packages on the ground surface may soil the package, and alternate drop off locations are often inconvenient requiring the consumer to walk to the mailbox, mail room, or other more distant location than a front step or porch. Alternatively, even with sufficient space for delivering a package, the package may be at risk of theft. Often, packages are delivered to a doorstep with no notification to the user of the delivery, potentially resulting in large delays between delivery and retrieval of the delivery. Additionally, many individuals may be at work or otherwise not at home at the time of delivery, leaving the package vulnerable to theft for extended periods. In order to address these concerns, the present invention provides users with a delivery shelf system installable in the vicinity of the door, wherein the delivery shelf may provide delivery notifications and security until the package is retrieved.

In light of the devices disclosed in the known art, it is submitted that the present invention substantially diverges in design elements from the known art and consequently it is clear that there is a need in the art for an improvement to existing delivery receptacles. In this regard, the instant invention substantially fulfills these needs.

SUMMARY OF THE INVENTION

In view of the foregoing disadvantages inherent in the known types of delivery storage platforms now present in the known art, the present invention provides a deployable delivery shelf system wherein the same can be utilized for providing convenience for the user when receiving a parcel or other delivery.

The present system comprises a platform hingedly affixed to a mounting base, wherein a rear edge of the platform is hingedly affixed along a lower edge of the mounting base such that the platform is selectively movable between a deployed position and a storage position. The platform is substantially perpendicular to the mounting base when in the deployed position and an upper surface of the platform rests flush against a front surface of the mounting base when the platform is in the storage position. An extension panel is telescopically disposed within a front edge of the platform. The extension panel is selectively movable between an extended position and a retracted position, wherein the extension panel is disposed entirely within an interior of the platform when in the retracted position. In some embodiments, a pair of lateral panels are telescopically disposed within opposing lateral edges of the platform, wherein the pair of lateral panels are selectively movable between an extended position and a retracted position. In another embodiment, the pair of lateral panels are disposed entirely within the platform when in the retracted position. In other embodiments, a proximal end of each lateral panel of the pair of lateral panels is pivotally affixed to the platform when in the extended position, such that each lateral panel is selectively movable to a raised position perpendicular to the upper surface of the platform. In yet another embodiment, the interior edge of the extension panel is pivotally affixed to the platform when in the extended position perpendicular to the upper surface of the platform. In some embodiments, the platform, the pair of lateral panels, and the extension panel define a container having an open upper end when each of the pair of lateral panels and the extension panel are disposed in the raised position. In another embodiment, at least one fastener is disposed on each of the pair of lateral panels and the extension panel, wherein the at least one fastener selectively affixes the pair of lateral panels to the extension panel to retain the pair of lateral panels and the extension panel in the raised position. In other embodiments, the at least one fastener is configured to engage the extension panel and the pair of lateral panels in a locked configuration, such that the extension panel and pair of lateral panels are retained in the raised position until a locking mechanism operably connected to the at least one fastener is disengaged. In yet another embodiment, a proximity sensor is disposed within the mounting base, wherein the proximity sensor is configured to detect a remote housing within a threshold proximity of the mounting base whereupon the locking mechanism is configured to disengage when the remote housing is detected within the threshold proximity. In some embodiments, a camera is disposed on a control panel affixed to a lateral edge of the mounting base, wherein the camera is operably connected to a processor having facial recognition software thereon, wherein the facial recognition software is configured to identify one or more authorized users, whereupon detection of an authorized user, the locking mechanism is configured to disengage. In another embodiment, a primary display is disposed on a lower surface of the platform, wherein the primary display is operably connected to a remote device and configured to display media received from the remote device. In other embodiments, a secondary display is disposed within the front surface of the mounting base, wherein the secondary display is disabled when the platform is in the storage position and is configured to mirror the primary display when the platform is in the deployed position. In yet another embodiment, a control panel is affixed to a side of the mounting base, wherein the control panel comprises a notification control thereon, whereupon actuation of the notification control, an alert is transmitted by a wireless transceiver disposed within the control panel to a remote device. In some embodiments, a camera is disposed on the control panel, wherein the camera is configured to transmit a video image to the remote device. In another embodiment, the remote device further comprises a delivery application thereon configured to track a location of a parcel, whereupon detection of the parcel within a threshold proximity to the delivery shelf, the platform is configured to move to the deployed position via actuation of a platform motor disposed within the mounting base and operably connected to the platform. In other embodiments, a panel motor is disposed within the platform and is operably connected to the extension panel, wherein the panel motor is configured to selectively move the extension panel from the retracted position to the extended position when actuated in a first direction, and from the extended position to the retracted position when actuated in a second direction. In yet another embodiment, a pair of lateral panel motors are disposed within the platform, wherein each lateral panel motor is operably connected to one lateral panel of the pair of lateral panels, wherein each lateral panel motor is configured to selectively move the associated lateral panel from the retracted position to the extended position when actuated in a first direction, and from the extended position to the retracted position when actuated in a second direction. In some embodiments, at least one hook is disposed on the lower edge of the mounting base. In another embodiment, a front panel pivotally affixed along an upper edge of the mounting base, wherein the front panel is configured to pivot to a position perpendicular to a front surface of the mounting base to enclose the container formed by the pair of lateral panels and the extension panel when in the raised position.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
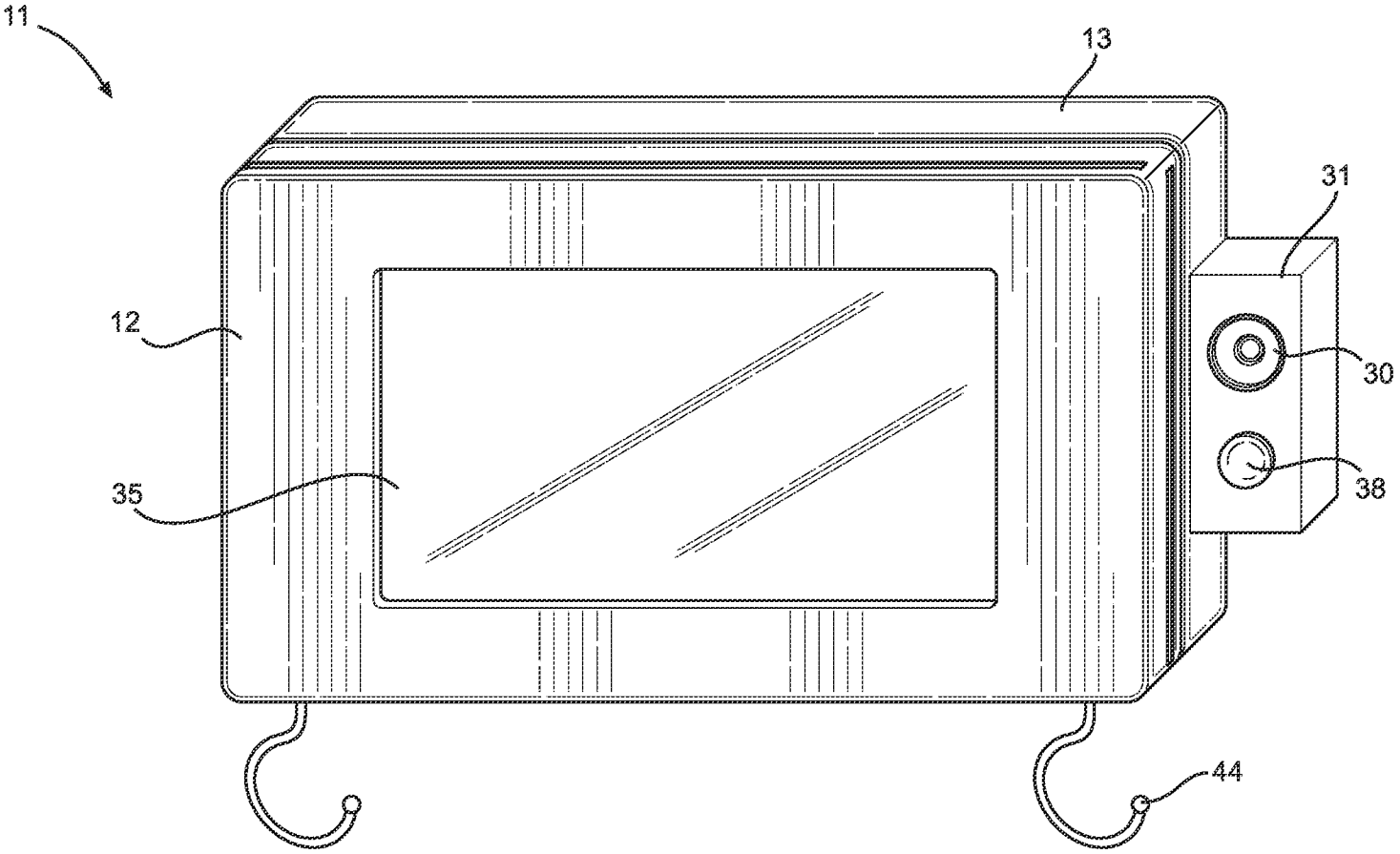
FIG. 1A shows a perspective view of an embodiment of the delivery shelf in a storage position.

Reference is made herein to the attached drawings. Like reference numerals are used throughout the drawings to depict like or similar elements of the delivery shelf. The figures are intended for representative purposes only and should not be considered to be limiting in any respect.

According to some embodiments, the operations, techniques, and/or components described herein can be implemented as (i) a special-purpose computing device having specialized hardware and a logic hardwired into the computing device to persistently perform the disclosed operations and/or techniques or (ii) a logic that is implementable on an electronic device having a general purpose hardware processor to execute the logic and a computer-readable medium, e.g. a memory, wherein implementation of the logic by the processor on the electronic device provides the electronic device with the function of a special-purpose computing device.

In the interests of economy, the present disclosure refers to "a computer-readable medium," "a processor," and so on. However, this should not be read as limiting in any way as the present disclosure contemplates embodiments of the present invention utilizing "one or more computer-readable media," "one or more processors," and so on. Unless specifically limited to a single unit, "a" is intended to be equivalent to "one or more" throughout the present disclosure.

As referred to herein, the term "electronic device" refers to any computing device that includes at least a display screen and an input mechanism. The computing devices can be hard-wired to perform the operations, techniques, and/or components described herein, or can include digital electronic devices such as one or more application-specific integrated circuits (ASICs) or field programmable gate arrays (FPGAs) that are persistently programmed to perform the operations, techniques and/or components described herein, or can include one or more general purpose hardware processors programmed to perform such features of the present disclosure pursuant to program instructions in firmware, memory, other storage, or a combination. Such computing devices can also combine custom hard-wired logic, ASICs, or FPGAs with custom programming to accomplish the technique and other features of the present disclosure. The computing devices can be desktop computer systems, laptops, cell phones, tablets, networking devices, or any other device that incorporates hard-wired and/or program logic to implement the techniques and other features of the present disclosure.

Figure 1B:
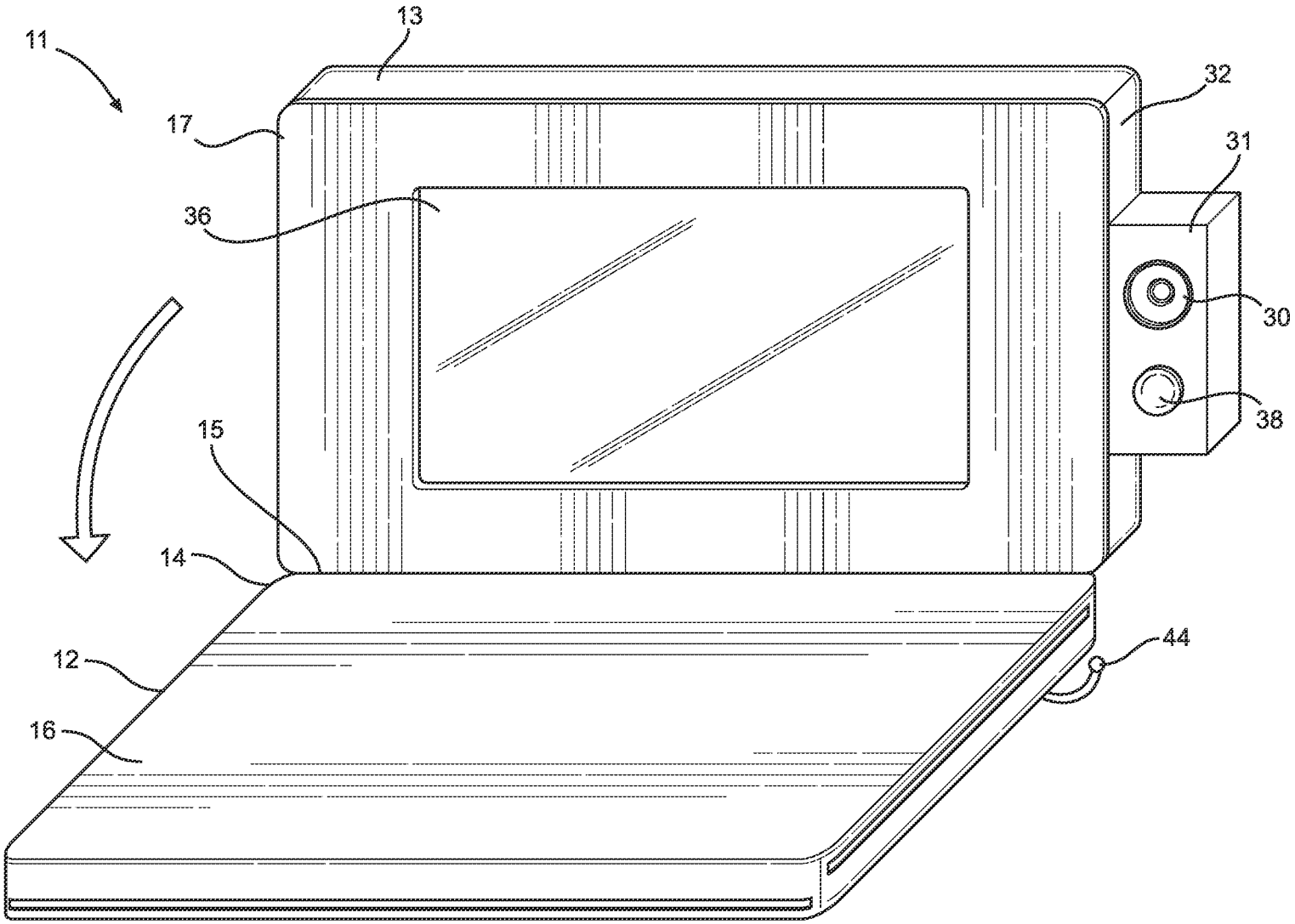
FIG. 1B shows a perspective view of an embodiment of the delivery shelf in a deployed position.

Referring now to FIGS. 1A and 1B, there is shown a perspective view of an embodiment of the delivery shelf in a storage position and a perspective view of an embodiment of the delivery shelf in a deployed position, respectively. The delivery shelf 11 comprises a platform 12 hingedly affixed to a lower edge 15 of a mounting base 13 along a rear edge 14 of the platform 12, such that the platform 12 is selectively movable between a storage position (as shown in FIG. 1A) and a deployed position (as shown in FIG. 1B). In the shown embodiment, the platform 12 is disposed along a substantially perpendicular plane relative to the mounting base 13 when in the deployed position, such that a level surface is provided for storing items on the platform 12. When in the storage position, an upper surface 16 of the platform 12 rests flush against a front surface 17 of the mounting base 13, so as to minimize form factor of the delivery shelf 11 when not in use. The mounting base 13 is contemplated to removably secure to a support surface, such as a wall adjacent to a front door of a home, such that the delivery shelf 11 is placed in proximity to the front door for convenience in retrieving a delivered item placed thereon. The mounting base 13 may further include fasteners, adhesives, mounting brackets, or other securement mechanisms on a rear surface thereof, such that the fasteners removably affix the mounting base 13 to the support surface. Alternatively, the mounting base 13 may include recesses into which fasteners affixed directly to the support surface are received, such that the mounting base 13 is supported thereon. In the illustrated embodiment, one or more hooks 44 are disposed on the lower edge 15 of the mounting base 13, such that bags or other delivered items can be secured to the one or more hooks 44. In this manner, multiple delivery support options are provided, such that the delivery shelf 11 can store an increased number of delivered items.

In the shown embodiments, a control panel 31 is affixed to a lateral edge 32 of the mounting base 13, wherein the control panel 31 is contemplated to house a variety of electronic components therein. In alternate embodiments, the control panel 31 may be affixed along an upper edge of the mounting base 13, such that the platform 12 does not occlude the electronic components when in the deployed position. In the shown embodiment, the control panel 31 includes a camera 30 therein, wherein the camera 30 is configured to receive and transmit video footage to a remote device (as shown in FIG. 4, 37), such as a smartphone, tablet, computer, or the like. In this manner, one-way or two-way video communication between the remote device and the delivery shelf 11 can be accomplished. Additionally, in some embodiments, the camera 30 is configured to passively record in the vicinity of the delivery shelf 11 to capture footage of any thieves taking items from the delivery shelf 11. In the shown embodiment, a primary display 35 is disposed on a lower surface of the platform 12, wherein the primary display is operably connected to the remote device, such that media received from the remote device can be displayed thereon. For example, text messages, delivery instructions, video communications facilitated by the camera 30, or any variety of alternate media options can be displayed on the primary display 35. In the shown embodiments, a secondary display 36 is disposed on the front surface 17 of the mounting base 13 and is configured to operate similarly to the primary display 35 as previously described. In some embodiments, the secondary display 36 is configured to mirror the primary display 35, such that messages or communications can be displayed thereon in either the deployed position or the storage position. In some such embodiments, when the platform 12 is in the deployed position, the secondary display 36 activates, while the primary display 35 deactivates. In this manner, power consumption is minimized to increase efficiency of the delivery shelf 11. In the shown embodiment, a notification control 38 is disposed on the control panel 31, wherein the notification control 38 is configured to transmit a notification to the remote device, such that the user is alerted to the presence of a delivery. The notification control 38 is contemplated to mimic a doorbell, or, in some embodiments, be operably connected to an existing doorbell system to inform the user of the presence of a delivery.

Figure 2A:
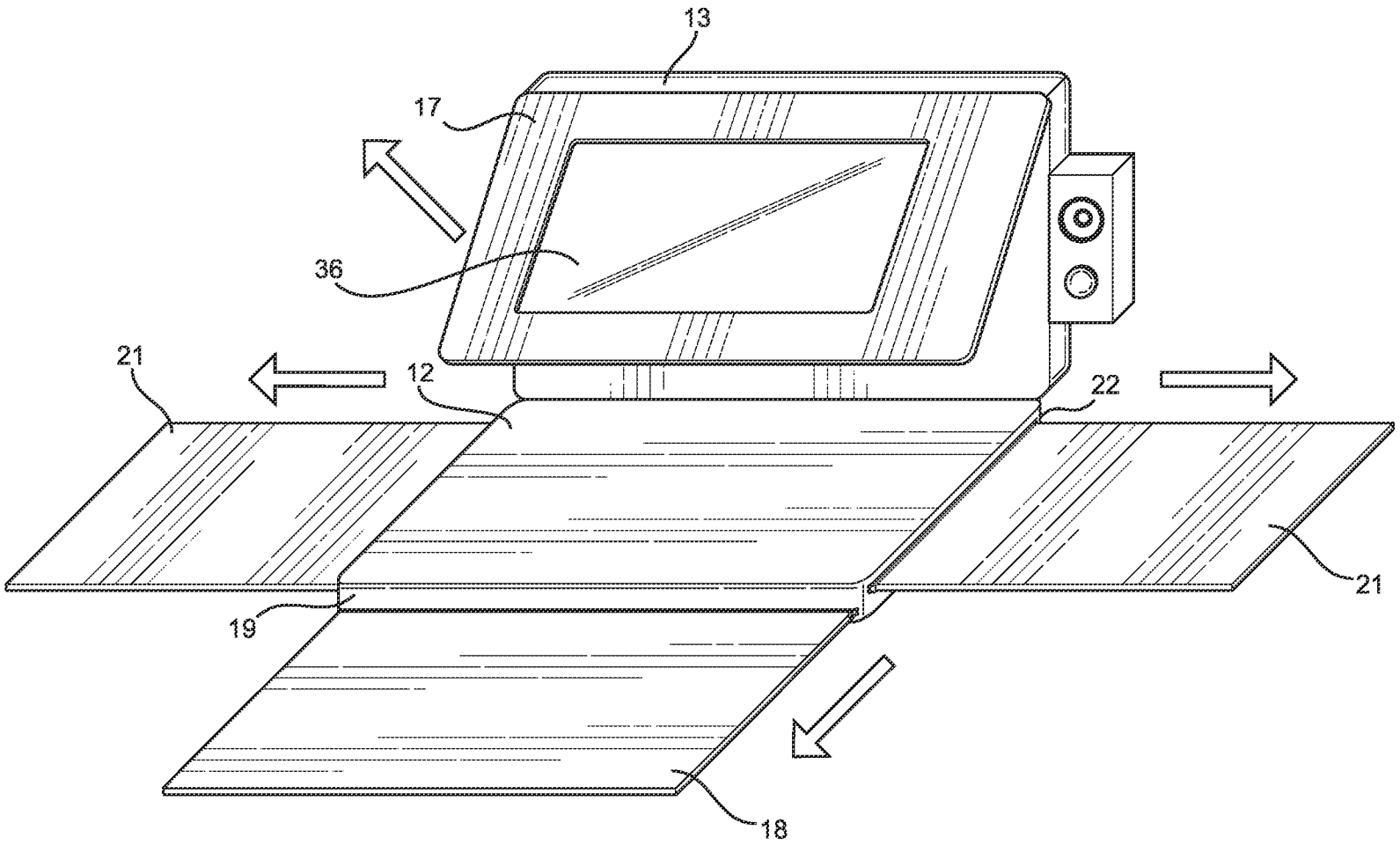
FIG. 2A shows a perspective view of an embodiment of the delivery shelf with panels in an extended position.
Figure 2B:
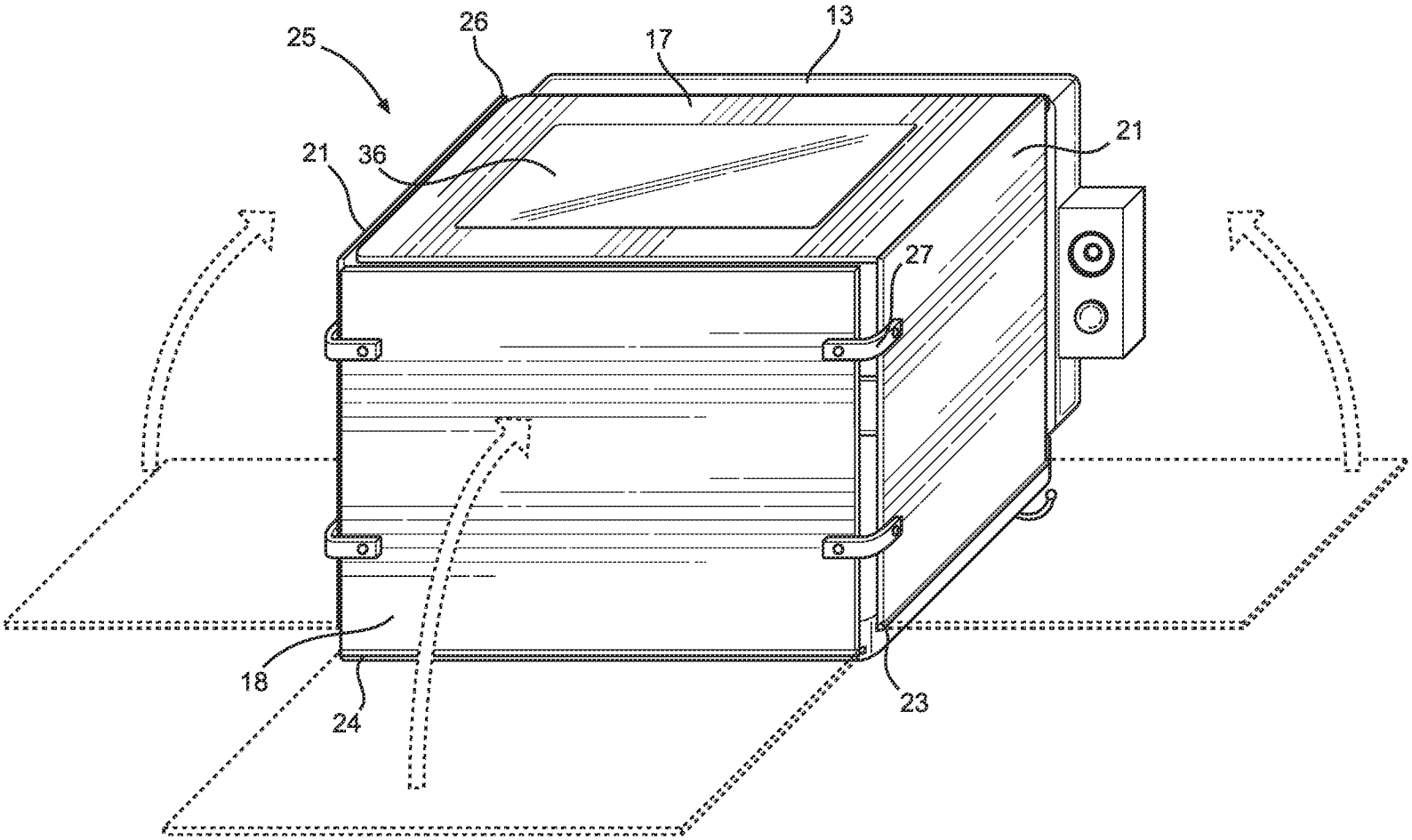
FIG. 2B shows a perspective view of an embodiment of the delivery shelf with panels in a raised position.

Referring now to FIGS. 2A and 2B, there is shown a perspective view of an embodiment of the delivery shelf with panels in an extended position and a perspective view of an embodiment of the delivery shelf with panels in a raised position, respectively. An extension panel 18 is telescopically disposed within the platform 12 along a front edge 19 thereof, wherein the extension panel 18 is selectively movable between an extended position and a retracted position. In the shown embodiment, the extension panel 18 is disposed entirely within the platform when in the retracted position, such that a distal edge of the extension panel 18 is flush with the front edge 19 of the platform 12. In some embodiments, the extension panel 18 extends via spring-biased latches, such that upon depression of the extension panel 18 deeper into the platform 12, the latch disengages allowing the extension panel 18 to extend from the platform. Alternatively, the extension panel 18 may be operably connected to a panel motor (as shown in FIG. 4, 42), such that the extension panel 18 extends upon actuation of the panel motor. In some embodiments, a cutout is disposed in the platform 12 exposing a portion of the extension panel 18, such that the user can grasp the exposed portion to manually move the extension panel 18 to the extended position. Similarly, a pair of lateral panels 21 are telescopically disposed within the platform 12 along opposing lateral edges 22 thereof, wherein the pair of lateral panels 21 are selectively movable between an extended position and a retracted position. The pair of lateral panels 21 are contemplated to operate in an identical manner as the extension panel 18 as previously described herein, such that each of the previously described embodiments of extension panel 18 may similarly be attributed to the pair of lateral panels 21. In the shown embodiment, the extension panel 18 is disposed along a parallel plane to each of the pair of lateral panels 21, wherein the extension panel 18 is disposed proximate to the front surface of the platform 12. Furthermore, in the illustrated embodiment, a front panel is hingedly affixed to the mounting base 13 along an upper edge of the mounting base 13, wherein the front panel pivots outwardly from the mounting base 13 to selectively move between a raised position substantially perpendicular to the mounting base 13 and a lowered position flush against a front surface of the mounting base 13. In such embodiments, the secondary display 36 is disposed on the front panel. In this manner, each of the panels can effectively extend the surface area of the platform 12 to receive more packages thereon.

As shown in FIG. 2B, each of the pair of lateral panels 21 and the extension panel 18 are contemplated to pivot about a proximal end 23 of the pair of lateral panels and an interior edge 24 of the extension panel 18, respectively, such that the panels are selectively movable between a lowered position and a raised position. In such embodiments, the pair of lateral panels 21 and the extension panel 18 are configured to pivot only upon being fully extended from the platform 12. A hinge may be disposed on each panel adjacent to the proximal end 23 and the interior edge 24 in substantial alignment with the opposing lateral edges 22 and the front edge 19, respectively, wherein the panels pivot upwardly about the hinge. When each of the panels is in the raised position, the panels define a container 25 having an open upper end 26, wherein the open upper end 26 is defined by each distal edge of each panel. In some embodiments, the pair of lateral panels 21 and the extension panel 18 are dimensioned such that a distal edge of each of the panels are coplanar when in the raised position. In the illustrated embodiment, the front panel forms a lid to the container 25 to enclose a package within the container 25. In this manner, a package is protected by the enclosed container 25 to prevent theft thereof. In some embodiments, a locking mechanism selectively retains the panels in the raised positions to prevent unwanted access thereto. Alternatively, in the shown embodiment, at least one fastener 27 is affixed to adjacent panels, such that the panels are retained in the raised position thereby. In the shown embodiment, at least one fastener 27 comprises straps removably securable to the adjacent panels, however, in alternate embodiments, alternate fastening means are contemplated. For example, in an alternate embodiment, magnetic fasteners may be disposed along each edge of the panels, such that the magnetic fasteners engage to retain the panels in the raised position. The magnetic fasteners are contemplated to comprise electromagnetic systems, such that the magnetic fasteners may be automatically engaged or disengaged upon a triggering event, such as a remote housing entering a predefined threshold. In this manner, a user having an associated key fob device may automatically unlock the container 25 to retrieve a package stored therein. In some embodiments, the panels are dimensioned such that adjacent panels are in contact along the lateral edges thereof. In this manner, the container 25 defined by the panels forms a complete enclosure.

Figure 3:
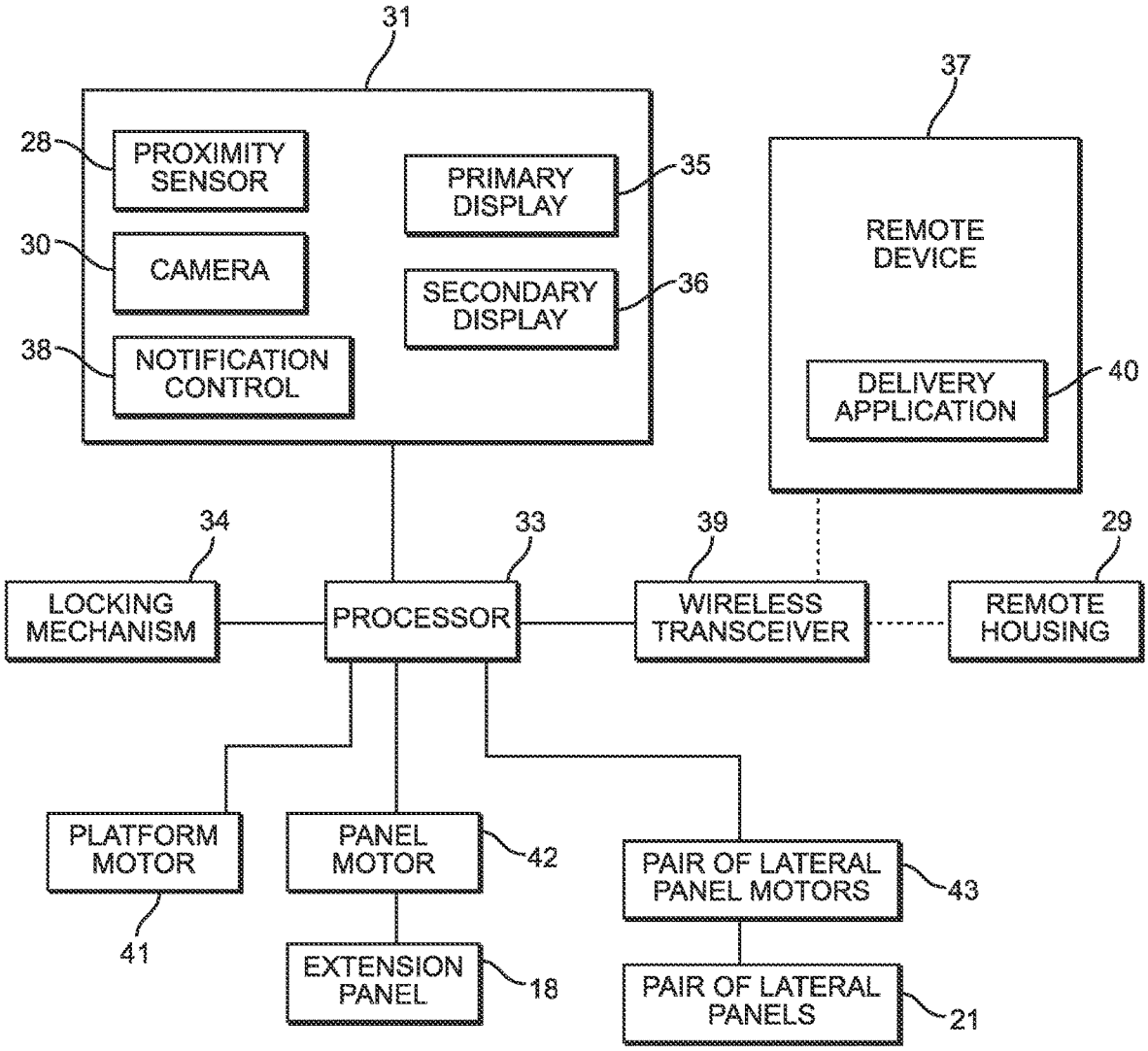
FIG. 3 shows a schematic view of an embodiment of the delivery shelf.

Referring now to FIG. 3, there is shown a schematic view of an embodiment of the delivery shelf. In the illustrated embodiment, the control panel 31 is operably connected to a processor 33, wherein the processor 33 is in wireless communication with the remote device 37 via a wireless transceiver 39. As such, when the camera 30 is activated, video footage is transmitted to the remote device 37 to establish two-way communication facilitated by one of the primary display 35 or the secondary display 36 as previously described herein. In some embodiments, a proximity sensor 28 is operably connected to the camera 30, such that upon actuation of the proximity sensor 28, the camera 30 is configured to activate and record footage to be stored locally or transmitted via a wireless transceiver 39 to the remote device 37.

In the illustrated embodiment, the extension panel 18 is operably connected to a panel motor 42, the pair of lateral panels 21 are operably connected to a pair of lateral panel motors 43, and the platform is operably connected to a platform motor 41. Each of the platform motor 41, panel motor 42, and pair of lateral panel motors 43 are configured to selectively actuate the associated element, such that the platform, extension panel 18, and the pair of lateral panels 21 can be automatically deployed thereby. In this manner, the user need not manually lower the platform and extend the desired panels. In some such embodiments, the motors 41, 42, 43, can be independently actuated to selectively deploy the desired elements as needed. Similarly, as previously described, the panel motors 42, 43 can selectively raise the associated panels to the raised position as shown in FIG. 2B to define the container for receiving and isolating delivered goods therein. Similarly, in alternate embodiments, the front panel can further be operably connected to an associated motor to automatically raise the front panel to enclose the container as needed. Once the extension panel 18 and the pair of lateral panels 21 are disposed in the raised position, a locking mechanism 34 can be actuated by the processor 33 to maintain the panels in the raised position.

In some embodiments, a remote housing 29 is in wireless communication with the processor, wherein the remote housing 29 is contemplated to be a fob or other identifying device. In such embodiments, upon detection of the remote housing 29 within a defined threshold distance of the delivery shelf, a variety of effects can be initiated. For example, in some embodiments, upon the remote housing 29 crossing the threshold, the various panels can be selectively extended, retracted, raised, lowered, locked, unlocked, or any number of preprogrammed behaviors within the processor 33. Alternatively, the processor 33 can be in communication with a delivery application 40 installed on the remote device 37, whereupon the delivery application 40 is configured to determine a location of the delivery relative to the delivery shelf, such that upon detection of the delivery within the defined threshold distance of the delivery shelf. In this manner, the delivery shelf can be paired to existing delivery tracking applications to provide additional automated functionality.

In one use, the delivery shelf is installed adjacent to the front door of a home. The user can deploy the platform to provide a surface on which deliveries can be placed to keep the deliveries off of the ground surface and to keep the front porch area clear for passage. The extension panel 18 and the pair of lateral panels 21 can be extended to expand the surface area of the platform for storage of larger packages or multiple smaller packages. In some embodiments, the panels can further be raised to define a container into which a package may be placed and secured. The user can manually deploy each of these panels, or, alternatively, the panels may be extended automatically via a series of motors as previously described upon an initiating trigger event. These trigger events may include detection of the delivery within a predefined threshold via an associated delivery application 40, a control being actuated on a remote device 37, detection of a remote housing within the predefined threshold, the camera 30 detecting a deliveryman within proximity of the delivery shelf, or the like. When the package is delivered, the user can communicate with the deliveryman via the primary or secondary displays 35, 36 in communication with the remote device 37.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly, and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A delivery shelf, comprising:

a platform hingedly affixed to a mounting base;

wherein a rear edge of the platform is hingedly affixed along a lower edge of the mounting base, such that the platform is selectively movable between a deployed position and a storage position;

wherein the platform is substantially perpendicular to the mounting base when in the deployed position and an upper surface of the platform rests flush against a front surface of the mounting base when the platform is in the storage position;

an extension panel telescopically disposed within a front edge of the platform;

wherein the extension panel is selectively movable between an extended position and a retracted position; and wherein the extension panel is disposed entirely within an interior of the platform when in the retracted position.

2. The delivery shelf of claim 1, further comprising a pair of lateral panels telescopically disposed within opposing lateral edges of the platform, wherein the pair of lateral panels are selectively movable between an extended position and a retracted position.

3. The delivery shelf of claim 2, wherein the pair of lateral panels are disposed entirely within the platform when in the retracted position.

4. The delivery shelf of claim 2, wherein a proximal end of each lateral panel of the pair of lateral panels is pivotally affixed to the platform when in the extended position, such that each lateral panel is selectively movable to a raised position perpendicular to the upper surface of the platform.

5. The delivery shelf of claim 4, wherein an interior edge of the extension panel is pivotally affixed to the platform when in the extended position, such that the extension panel is selectively movable to a raised position perpendicular to the upper surface of the platform.

6. The delivery shelf of claim 5, wherein the platform, the pair of lateral panels, and the extension panel define a container having an open upper end when each of the pair of lateral panels and the extension panel are disposed in the raised position.

7. The delivery shelf of claim 5, further comprising at least one fastener on each of the pair of lateral panels and the extension panel, wherein the at least one fastener selectively affixes the pair of lateral panels to the extension panel to retain the pair of lateral panels and the extension panel in the raised position.

8. The delivery shelf of claim 5, further comprising a locking mechanism, wherein the locking mechanism is configured to retain the extension panel and the pair of lateral panels in the raised position until the locking mechanism is disengaged.

9. The delivery shelf of claim 6, further comprising a front panel pivotally affixed along an upper edge of the mounting base, wherein the front panel is configured to pivot to a position perpendicular to the front surface of the mounting base to enclose the container formed by the pair of lateral panels and the extension panel when in the raised position.

10. The delivery shelf of claim 8, further comprising a proximity sensor disposed within the mounting base, the proximity sensor configured to detect a remote housing within a threshold proximity of the mounting base, whereupon the locking mechanism is configured to disengage when the remote housing is detected within the threshold proximity.

11. The delivery shelf of claim 8, further comprising a camera disposed on a control panel affixed to a lateral edge of the mounting base, wherein the camera is operably connected to a processor having facial recognition software thereon, wherein the facial recognition software is configured to identify one or more authorized users, whereupon detection of an authorized user, the locking mechanism is configured to disengage.

12. The delivery shelf of claim 2, further comprising a pair of lateral panel motors, wherein each lateral panel motor is operably connected to one lateral panel of the pair of lateral panels, wherein each lateral panel motor is configured to selectively move the associated lateral panel from the retracted position to the extended position when actuated in a first direction, and from the extended position to the retracted position when actuated in a second direction.

13. The delivery shelf of claim 1, further comprising a primary display disposed on a lower surface of the platform, wherein the primary display is operably connected to a remote device and configured to display media received from the remote device.

14. The delivery shelf of claim 13, further comprising a secondary display disposed within the front surface of the mounting base, wherein the secondary display is disabled when the platform is in the storage position and is configured to mirror the primary display when the platform is in the deployed position.

15. The delivery shelf of claim 1, further comprising a control panel affixed to a side of the mounting base, wherein the control panel comprises a notification control thereon, whereupon actuation of the notification control, an alert is transmitted by a wireless transceiver disposed within the control panel to a remote device.

16. The delivery shelf of claim 15, further comprising a camera disposed on the control panel, wherein the camera is configured to transmit a video image to the remote device.

17. The delivery shelf of claim 15, wherein the remote device further comprises a delivery application thereon configured to track a location of a parcel, whereupon detection of the parcel within a threshold proximity to the delivery shelf, the platform is configured to move to the deployed position via actuation of a platform motor disposed within the mounting base and operably connected to the platform.

18. The delivery shelf of claim 1, further comprising a panel motor disposed within the platform and operably connected to the extension panel, wherein the panel motor is configured to selectively move the extension panel from the retracted position to the extended position when actuated in a first direction, and from the extended position to the retracted position when actuated in a second direction.

19. The delivery shelf of claim 1, further comprising at least one hook disposed on the lower edge of the mounting base.

* * * * *